US007463082B2

(12) United States Patent
Chen

(10) Patent No.: US 7,463,082 B2
(45) Date of Patent: Dec. 9, 2008

(54) LIGHT EMITTING DEVICE AND CURRENT MIRROR THEREOF

(75) Inventor: Po Chang Chen, Taipei County (TW)

(73) Assignee: Princeton Technology Corporation, Taipei (TW)

( * ) Notice: Subject to any disclaimer, the term of this patent is extended or adjusted under 35 U.S.C. 154(b) by 37 days.

(21) Appl. No.: 11/657,516

(22) Filed: Jan. 25, 2007

(65) Prior Publication Data

US 2008/0042741 A1 Feb. 21, 2008

(30) Foreign Application Priority Data

Jun. 2, 2006 (TW) ..... 95209610 U

(51) Int. Cl.
*G05F 1/10* (2006.01)

(52) U.S. Cl. ..... 327/543; 327/427; 323/316

(58) Field of Classification Search ..... None
See application file for complete search history.

(56) References Cited

U.S. PATENT DOCUMENTS 5,847,556 A * 12/1998 Kothandaraman et al. ... 323/315
6,433,528 B1 * 8/2002 Bonelli et al. ..... 323/315
6,798,182 B2 * 9/2004 Charlon ..... 323/316
2007/0008255 A1 * 1/2007 Emek et al. ..... 345/82

* cited by examiner

*Primary Examiner*—Lincoln Donovan
*Assistant Examiner*—Terry L Englund
(74) *Attorney, Agent, or Firm*—Muncy, Geissler, Olds & Lowe, PLLC

(57) ABSTRACT

A current mirror has a first transistor and a second transistor. Current through the first and second transistors are an input current and an output current, respectively. The ratio of the output current to the input current is constant. The first and second transistors have the same voltage difference between the gate and source. The voltage difference between the drain and source of the second transistor is equalized to that of the first transistor by a first operational amplifier, and the voltage difference between the drain and source of the first transistor is equalized to a control voltage by a second operational amplifier. By setting the value of the control voltage, the first and second transistors can operate in triode region to simultaneously provide high output current and sufficient potential for a load.

12 Claims, 5 Drawing Sheets

LIGHT EMITTING DEVICE AND CURRENT MIRROR THEREOF

BACKGROUND OF THE INVENTION

1. Field of the Invention

The invention relates to light emitting devices and particularly to current mirrors thereof for heavy loading.

2. Description of the Related Art

FIG. 1 is a chart showing drain current $i_D$ of an NMOS transistor, dependent on $V_{DS}$ and $V_{GS}$, where $V_{DS}$ represents voltage difference between drain and source of the NMOS transistor and $V_{GS}$ represents voltage difference between gate and source of the NMOS transistor. $V_t$ represents threshold voltage of the NMOS transistor. When $V_{DS}<(V_{GS}-V_t)$, the NMOS transistor operates in triode region and the drain current of the NMOS transistor ($i_D$) equals $$\frac{1}{2}\mu_n C_{ox}\frac{W}{L}[2(V_{GS}-V_t)V_{DS}-V_{DS}^2].$$

When $V_{DS}>(V_{GS}-V_t)$, the NMOS transistor operates in saturation region and $i_D$ equals $$\frac{1}{2}\mu_n C_{ox}\frac{W}{L}(V_{GS}-V_t)^2.$$

As shown in FIG. 1 and the formulae, the drain current of the NMOS transistor ($i_D$) increases with the voltage difference between the gate and source of the NMOS transistor ($V_{GS}$).

FIG. 2 shows a conventional current mirror, comprising two NMOS transistors 202 and 204 having the same voltage difference between the gate and source ($V_{GS}$), the same charge carrier mobility ($\mu_n$), the same gate oxide capacitance per unit ($C_{ox}$), and gate width to length ratios (W/L) in a ratio of 1:N. The drain and gate of the NMOS transistor 202 are connected to operate in a saturation region. The current through the NMOS transistor 202 is I. The NMOS transistor 204 must operate in the saturation region to ensure load current ($I_L$) is N times the current through the NMOS transistor 202, $I_L$=N·I. The current mirror 200 provides a potential ($V_{DD}-V_{DS}$) for the load 206. The voltage difference between the drain and source, $V_{DS}$, of the NMOS transistor 204 should be finite to provide sufficient potential for load 206. As shown in FIG. 1, to operate in saturation region with low voltage difference between the drain and source ($V_{DS}$), the voltage difference between the gate and source ($V_{GS}$) of the NMOS transistor 204 must be very low, such that current through drain ($i_D$) is correspondingly low. To provide large load current $I_L$, a conventional solution increases the size of the NMOS transistor 204. However, with current trends favoring small ICs, the increased size of transistors is problematic. A novel current mirror for heavy load (large load current) providing sufficient potential for the load is called for.

BRIEF SUMMARY OF THE INVENTION

The invention provides small size current mirrors for heavy load providing sufficient potential for the load. One embodiment of such a current mirror comprises an input circuit, an output circuit, a first operational amplifier, a control circuit, and a second operational amplifier. The input circuit comprises a first transistor. The current through the first transistor is an input current. The output circuit comprises a second transistor having the same voltage difference between the gate and the source as the first transistor. The current through the second transistor is an output current. The ratio of the input current to the output current is constant. The first operational amplifier generates an output signal based on the voltage difference between the drain and source of the first transistor and that of the second transistor. According to the output signal, the control circuit adjusts the voltage difference between the drain and source of the second transistor to equalize the voltage difference between the drain and source of the first transistor and that of the second transistor. According to the voltage difference between the drain and source of the first transistor and a control voltage, the second operational amplifier controls the first transistor to equalize the voltage difference between the drain and source of the first transistor and the control voltage. By setting the control voltage, the first and second transistors can be controlled to operate in triode region.

The control circuit comprises a third transistor. The gate of the third transistor is coupled to the output terminal of the first operational amplifier. The source of the third transistor is coupled to the inverting terminal of the first operational amplifier and the drain of the second transistor. The drain of the third transistor is a load terminal of the current mirror. The load terminal can couple to a load. The output current flows through the load. The gate of the first transistor couples to the output terminal of the second operational amplifier. The drain of the first transistor is coupled to the non-inverting terminal of the second operational amplifier. The ratio of the output current to the input current is dependent on the gate width to length ratios of the first and second transistors. In one embodiment, the first, second, and third transistors may be implemented by NMOS transistors. In another embodiment, the first, second, and third transistors may be implemented by PMOS transistors In one embodiment of the invention, the load may be a plurality of serially coupled light emitting diodes. Because the second transistor is operated in triode region, the voltage difference between the drain and source of the second transistor is very low. As voltage difference between the drain and source of the second transistor decreases, the total number of the light emitting diodes coupled to the load terminal of the current mirror increases accordingly.

The above and other advantages will become more apparent with reference to the following description taken in conjunction with the accompanying drawings.

BRIEF DESCRIPTION OF THE DRAWINGS

The invention can be more fully understood by reading the subsequent detailed description and examples with references made to the accompanying drawings, wherein.

DETAILED DESCRIPTION OF THE INVENTION

The following description is of the best-contemplated mode of carrying out the invention. This description is made for the purpose of illustrating the general principles of the invention and should not be taken in a limiting sense. The scope of the invention is best determined by reference to the appended claims.

Figure 3:
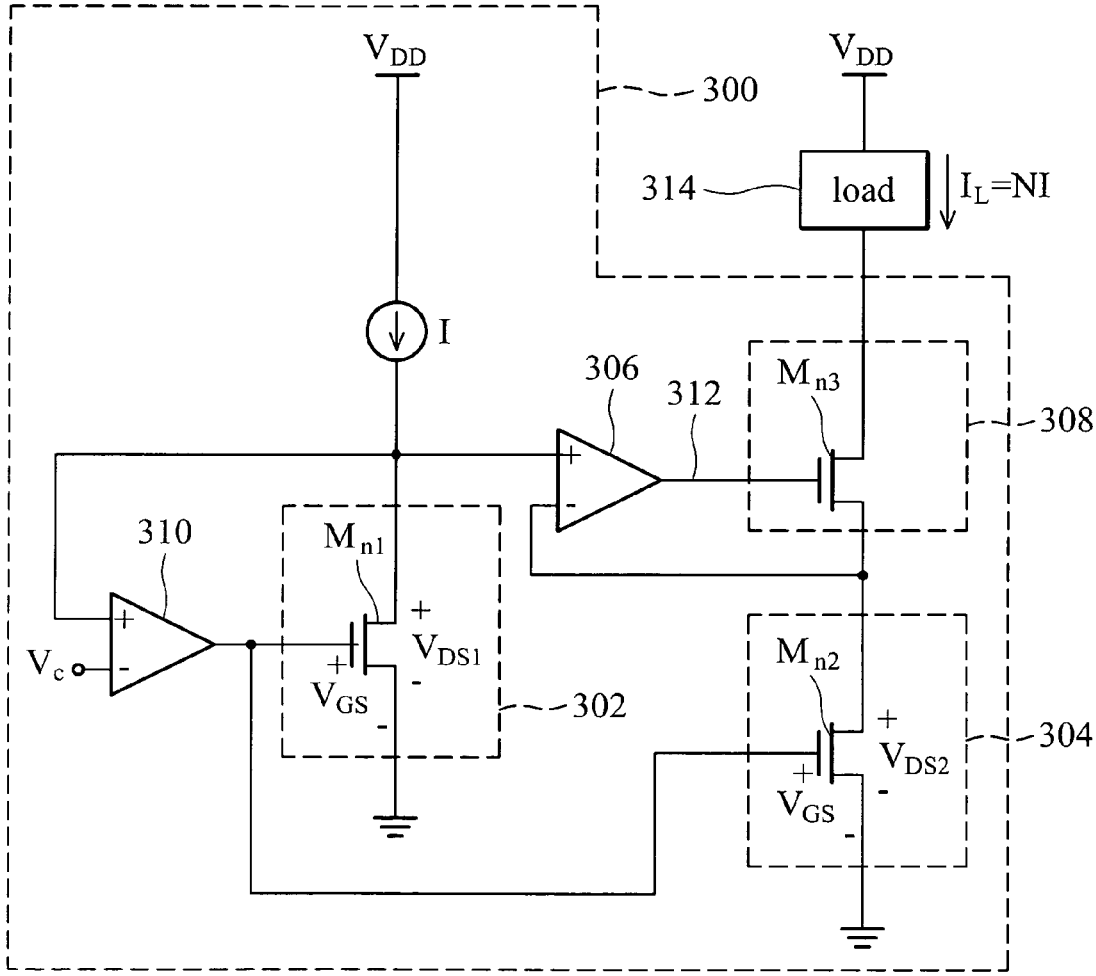
FIG. 3 shows an embodiment of a current mirror of the invention.

FIG. 3 illustrates an embodiment of a current mirror of the invention, comprising an input circuit 302, an output circuit 304, a first operational amplifier 306, a control circuit 308, and a second operational amplifier 310. The input circuit 302 comprises a first NMOS transistor $M_{n1}$. An input current (I) flows through the first NMOS transistor $M_{n1}$. The output circuit 304 comprises a second NMOS transistor $M_{n2}$. An output current ($I_L$) flows through the second transistor $M_{n2}$. The ratio of the output current ($I_L$) to the input current (I) is N, which is a constant number. The gate of the first NMOS transistor $M_{n1}$ is coupled to the output terminal of the second operational amplifier 310. The drain of the first NMOS transistor $M_{n1}$ is coupled to the non-inverting terminal of the second operational amplifier 310. The first and second NMOS transistors $M_{n1}$ and $M_{n2}$ have the same voltage difference between the gate and source ($V_{GS}$). The gate width to length ratio (W/L) of the first NMOS transistor $M_{n1}$ and that of the second NMOS transistor $M_{n2}$ are at a ratio of 1:N. The first operational amplifier 306 generates an output signal 312 based on the voltage difference between the drain and source of the first NMOS transistor $M_{n1}$ and that of the second NMOS transistor $M_{n2}$ ($V_{DS1}$ and $V_{DS2}$). The control circuit 308 adjusts the voltage difference between the drain and source of the second NMOS transistor $M_{n2}$ ($V_{DS2}$) according to the output signal 312, and the voltage difference between the drain and source of the second NMOS transistor $M_{n2}$ ($V_{DS2}$) is equalized to that of the first NMOS transistor $M_{n1}$ ($V_{DS1}$). In the embodiment shown in FIG. 3, the control circuit 308 comprises a third NMOS transistor $M_{n3}$ having a gate coupling to the output terminal of the first operational amplifier 306, a source coupling to the inverting terminal of the first operational amplifier 306 and the drain of the second NMOS transistor $M_{n2}$, and a drain functioning as a load terminal of the current mirror 300. Load 314 is coupled to the load terminal. The output current $I_L$ flows through the load 314. According to a control voltage $V_c$ and the voltage difference between the drain and source of the first NMOS transistor $M_{n1}$ ($V_{DS1}$), the second operational amplifier 310 controls the first NMOS transistor $M_{n1}$ to equalize the voltage difference between the drain and source of the first NMOS transistor $M_{n1}$ ($V_{DS1}$) and the control voltage $V_c$.

The voltage differences between the drain and source of the first and second NMOS transistors $M_{n1}$ and $M_{n2}$ ($V_{DS1}$ and $V_{DS2}$) are equalized to the control voltage $V_c$ by the current mirror 300, and the first and second NMOS transistors $M_{n1}$ and $M_{n2}$ have the same voltage difference between the gate and source ($V_{GS}$), hence the first and second NMOS transistors $M_{n1}$ and $M_{n2}$ can be operated in triode region by properly setting the control voltage $V_c$. When the first and second NMOS transistors $M_{n1}$ and $M_{n2}$ operate in triode region, the input current $$I \text{ is } \frac{1}{2}\mu_n C_{ox}\left(\frac{W}{L}\right)_{M_{n1}}[2(V_{GS}-V_t)V_C-V_C^2],$$

and the output current $I_L$ is $$\frac{1}{2}\mu_n C_{ox}\left(\frac{W}{L}\right)_{M_{n2}}[2(V_{GS}-V_t)\times V_C-V_C^2]$$

which equals NI since $$\left(\frac{W}{L}\right)_{M_{n2}}=N\left(\frac{W}{L}\right)_{M_{n1}}.$$

Figure 1:
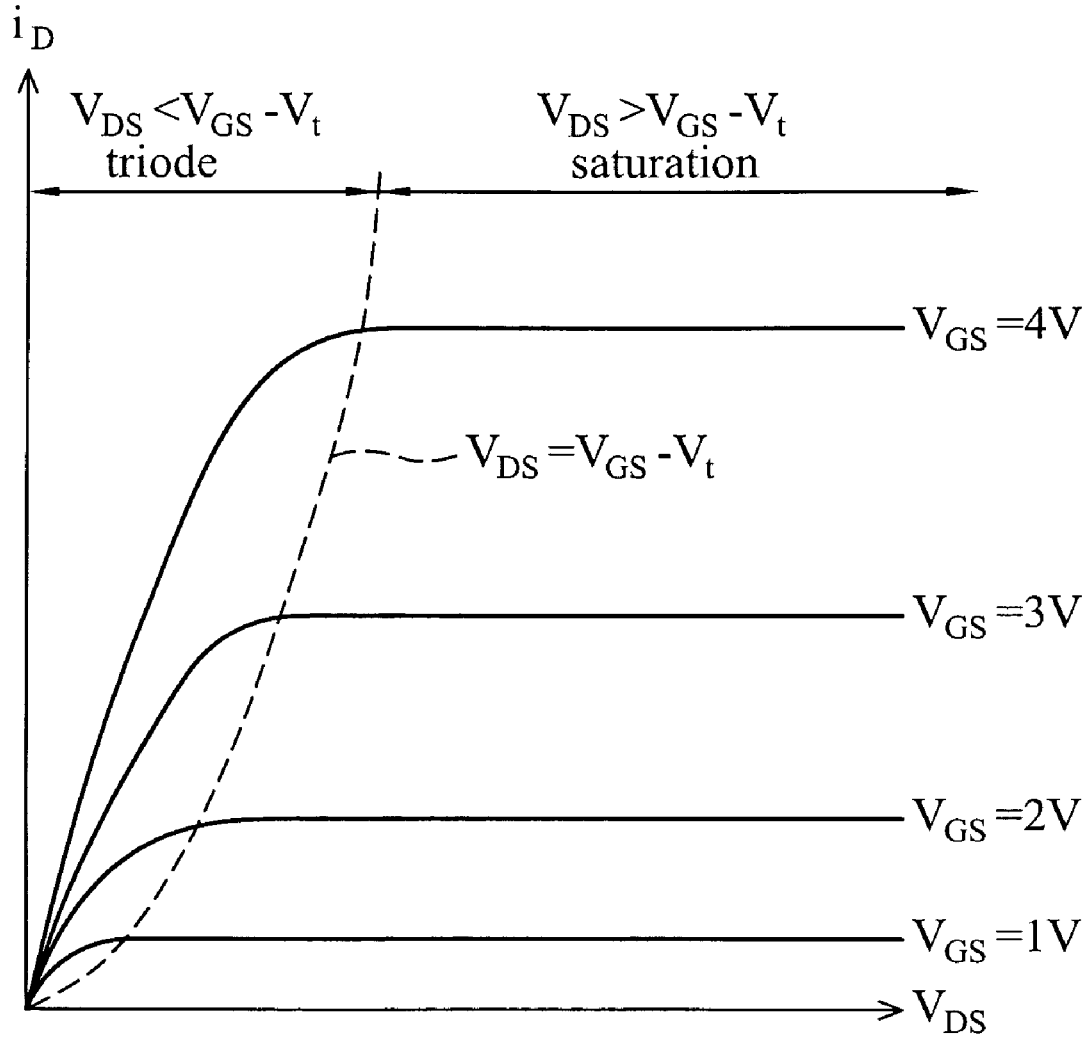
FIG. 1 (PRIOR ART)
FIG. 1 is a chart showing drain current $i_D$ of an NMOS transistor, which is dependent on $V_{DS}$ and $V_{GS}$.

Because the control voltage $V_c$ can be very low, the voltage difference between the drain and source of the second NMOS transistor $M_{n2}$ ($V_{DS2}$) equaling the control voltage $V_c$ is very low and therefore there is sufficient potential ($V_{DD}-V_{DS2}$) for the load 314. Compared with the conventional current mirror 200 shown in FIG. 2, another advantage of the invention is that the voltage difference between the gate and source of the first and second transistors (shown in FIG. 3) can be high because it is not necessary to limit the first and second transistors ($M_{n1}$ and $M_{n2}$) of the invention to operate in saturation region as that of the conventional current mirror shown in FIG. 1. When a high output current $I_L$ is required, the current mirror 300 increases the voltage difference between the gate and source of the first and second transistors ($V_{GS}$) rather than increasing the size of the first and second transistors ($M_{n1}$ and $M_{n2}$). The invention, therefore, provides high output current and sufficient potential for a load, and is small.

Figure 4:
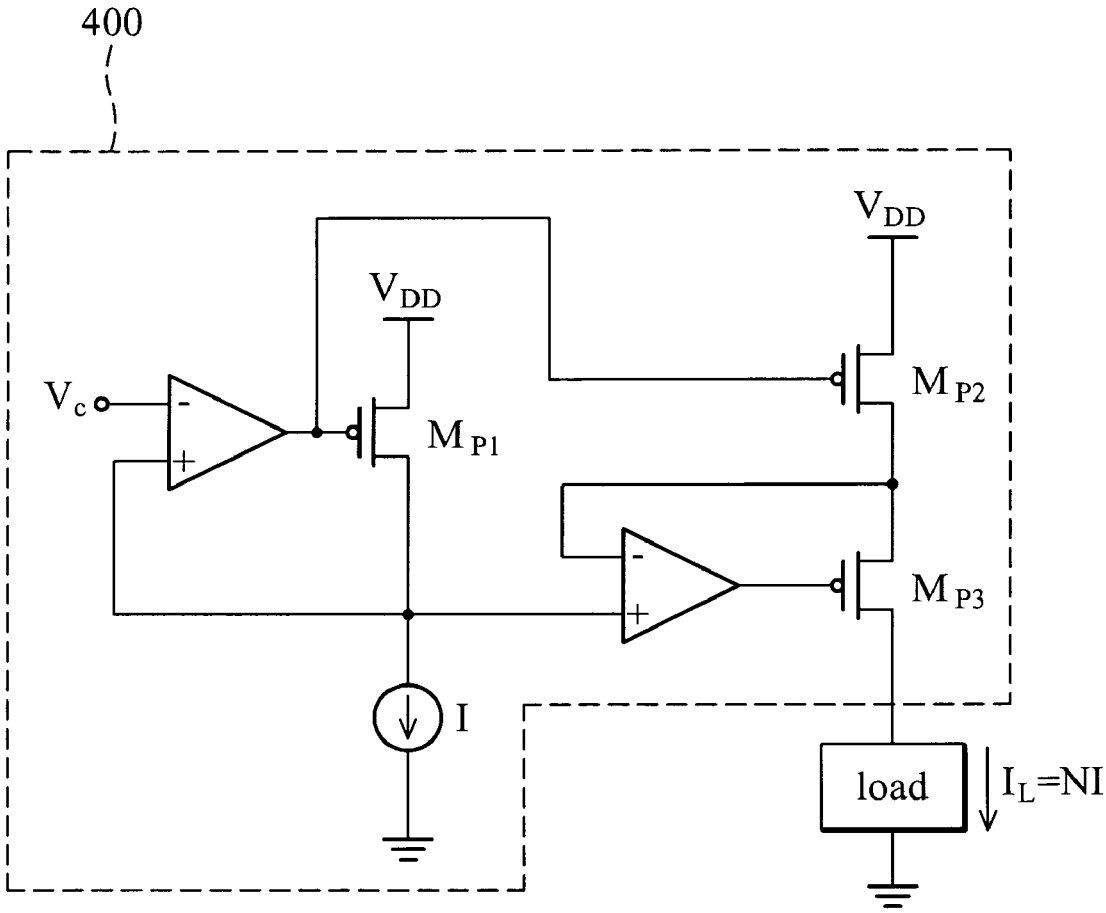
FIG. 4 shows another embodiment of a current mirror of the invention.

FIG. 4 shows another embodiment of a current mirror of the invention. The transistors ($M_{p1}$ $M_{p2}$ and $M_{p3}$) in the current mirror 400 are PMOS transistors. The techniques of the current mirror 400 are similar to those of the current mirror 300.

Figure 5:
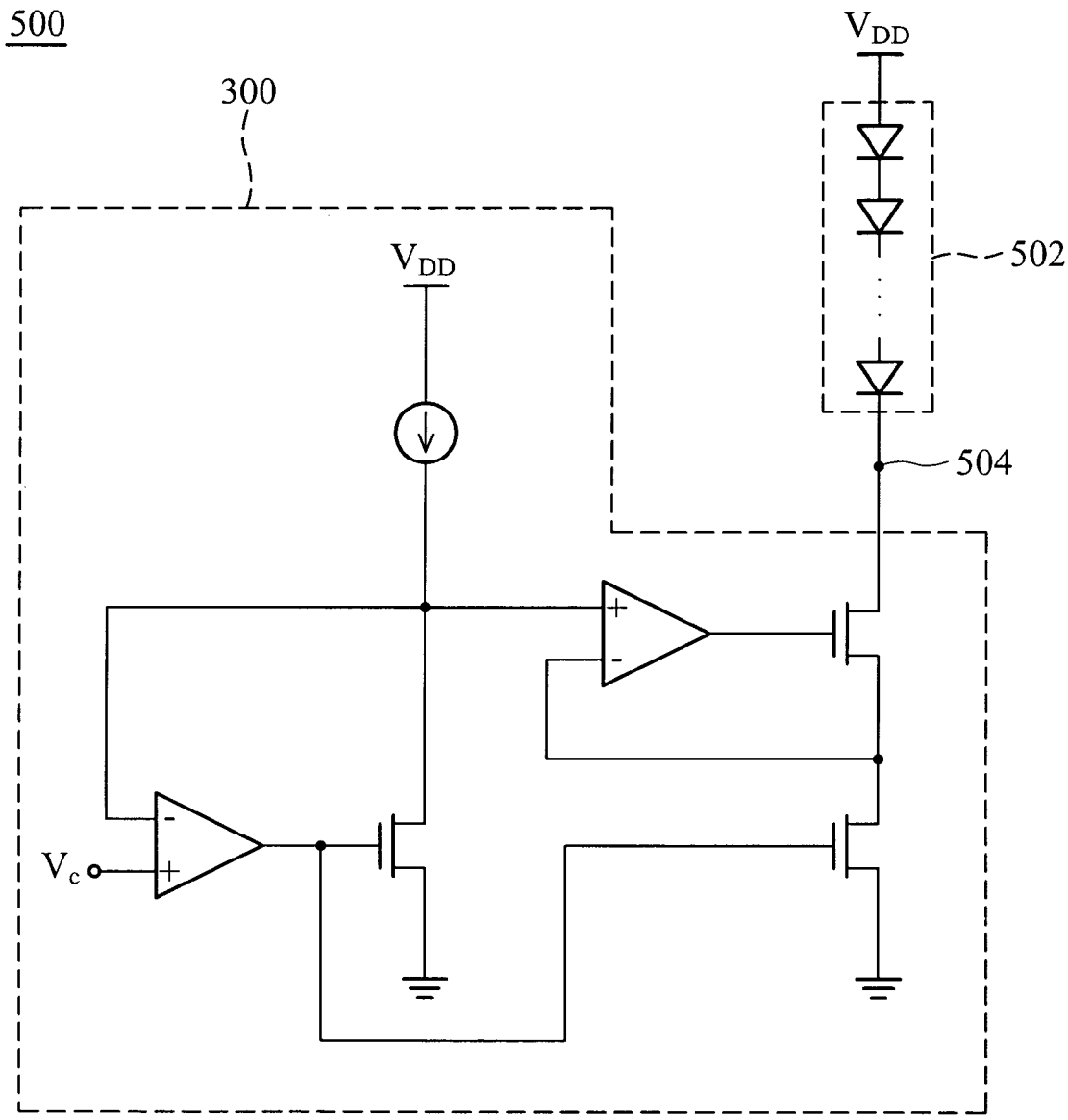
FIG. 5 shows a light emitting device of the invention.

As shown in FIG. 5, a light emitting device 500 is also provided. The light emitting device 500 comprises the current mirror 300 (shown in FIG. 3) and a load 502. In this embodiment, the load 502 consists of a plurality light emitting diodes (LEDs) which are serially coupled. Because of the advantage of the current mirror 300, the voltage level of the load terminal 504 is very low and therefore numerous LEDs are serially coupled between the voltage source $V_{DD}$ and the load terminal 504. The current mirror 400 can also be applied in the light emitting device 500 as shown in FIG. 5.

Figure 2:
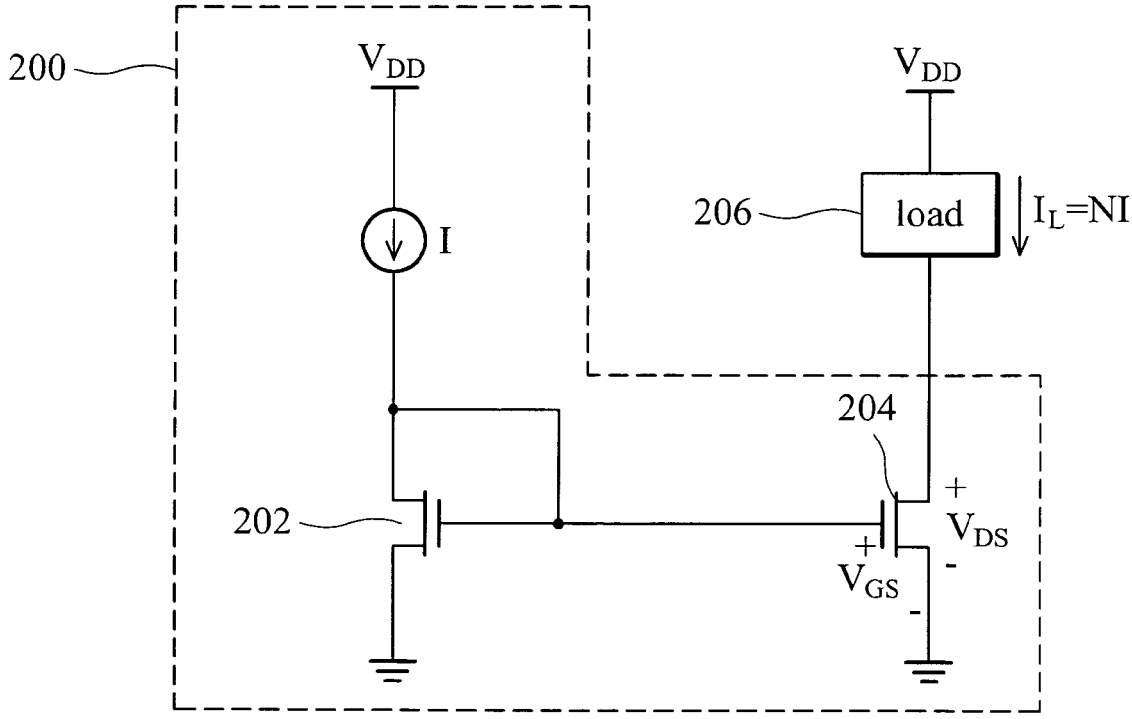
FIG. 2 (PRIOR ART)
FIG. 2 shows a conventional current mirror.

In conventional IC design, pluralities of output transistors, similar to the transistor 204 shown in FIG. 2, coupled to a single input transistor, similar to the transistor 202 shown in FIG. 2, to generate a plurality of output currents for a plurality of loads. A gradient effect occurs in the output transistors far from the input transistor. Because of the gradient effect, the output transistor and the input transistor have dissimilar voltage differences between the gate and source ($V_{GS}$). Application of the disclosed technology to replace conventional current mirrors provides high output currents by increasing the voltage difference between the gate and source ($V_{GS}$) of the transistors. Because of high $V_{GS}$, the variation in $V_{GS}$ caused by gradient effect is negligible and variation in output currents can be ignored.

While the invention has been described by way of example and in terms of preferred embodiment, it is to be understood that the invention is not limited thereto. To the contrary, it is intended to cover various modifications and similar arrangements (as would be apparent to those skilled in the art). Therefore, the scope of the appended claims should be accorded to the broadest interpretation so as to encompass all such modifications and similar arrangements.

What is claimed is:

1. A current mirror, comprising:

an input circuit, comprising a first transistor having a gate, a drain and a source, wherein current through the first transistor is an input current;

an output circuit, comprising a second transistor having a gate, a drain and a source, and having the same voltage difference between the gate and source as the first transistor, wherein current through the second transistor is an output current, and ratio of the output current to the input current is constant;

a first operational amplifier, generating an output signal based on the voltage difference between the drain and source of the first transistor and that of the second transistor;

a control circuit, adjusting the voltage difference between the drain and source of the second transistor based on the output signal to equalize the voltage difference between the drain and source of the first transistor and that of the second transistor; and a second operational amplifier, controlling the first transistor based on a control voltage and the voltage difference between the drain and source of the first transistor to equalize the voltage difference between the drain and source of the first transistor and the control voltage;

wherein the first and second transistors are controlled to operate in triode region by setting the value of the control voltage.

2. The current mirror as claimed in claim 1, wherein the control circuit comprises a third transistor having a gate coupling to an output terminal of the first operational amplifier to receive the output signal, a source coupling to the inverting terminal of the first operational amplifier and the drain of the second transistor, and a drain acting as a load terminal of the current mirror for coupling to a load, wherein the current through the load is the output current.

3. The current mirror as claimed in claim 1, wherein the gate of the first transistor is coupled to an output terminal of the second operational amplifier, and the drain of the first transistor is coupled to the non-inverting terminal of the second operational amplifier.

4. The current mirror as claimed in claim 1, wherein the ratio of the output current to the input current is dependent on the gate width to length ratios of the first and second transistors.

5. The current mirror as claimed in claim 1. wherein the first and second transistors are implemented by NMOS transistors.

6. The current mirror as claimed in claim 1, wherein the first and second transistors are implemented by PMOS transistors.

7. A light emitting device, comprising:

a plurality of light emitting diodes; and current mirror, comprising:

an input circuit, comprising a first transistor having a gate, a drain and a source, wherein current through the first transistor is an input current;

an output circuit, comprising a second transistor having a gate, a drain and a source and having the same voltage difference between the gate and source as the first transistor, wherein current through the second transistor is an output current, and ratio of the output current to the input current is constant;

a first operational amplifier, generating an output signal based on the voltage difference between the drain and source of the first transistor and that of the second transistor;

a control circuit, adjusting the voltage difference between the drain and source of the second transistor based on the output signal to equalize the voltage difference between the drain and source of the first transistor and that of the second transistor, wherein the control circuit has a load terminal coupling to the light emitting diodes for providing the output current to the light emitting diodes; and a second operational amplifier, controlling the first transistor based on a control voltage and the voltage difference between the drain and source of the first transistor to equalize the voltage difference between the drain and source of the first transistor and the control voltage;

wherein the first and second transistors are controlled to operate in triode region by setting the value of the control voltage.

8. The light emitting device as claimed in claim 7, wherein the control circuit comprises a third transistor having a gate coupling to an output terminal of the first operational amplifier to receive the output signal, a source coupling to the inverting terminal of the first operational amplifier and the drain of the second transistor, and a drain functioning as the load terminal.

9. The light emitting device as claimed in claim 7, wherein the gate of the first transistor is coupled to an output terminal of the second operational amplifier, and the drain of the first transistor is coupled to the non-inverting terminal of the second operational amplifier.

10. The light emitting device as claimed in claim 7, wherein the ratio of the output current to the input current is dependent on the gate width to length ratios of the first and second transistors.

11. The light emitting device as claimed in claim 7, wherein the first and second transistors are implemented by NMOS transistors.

12. The light emitting device as claimed in claim 7, wherein the first and second transistors are implemented by PMOS transistors.

* * * * *